US005156328A

United States Patent [19]

Wozniacki

[11] Patent Number: 5,156,328

[45] Date of Patent: Oct. 20, 1992

[54] SECURED COVER ASSEMBLY FOR CONTAINERS

[75] Inventor: Roger M. Wozniacki, Cumming, Ga.

[73] Assignee: Gaylord Container Corp., Deerfield, Ill.

[21] Appl. No.: 734,141

[22] Filed: Jul. 22, 1991

[51] Int. Cl.[5] ..... B65D 43/08; B65D 45/32

[52] U.S. Cl. ..... 229/125.22; 229/198

[58] Field of Search ..... 229/125.22, 192, 198

[56] References Cited

U.S. PATENT DOCUMENTS

| | | | |
|---|---|---|---|
| 310,599 | 1/1885 | Lybrand | 229/125.22 |
| 380,861 | 4/1888 | Collins | 229/198 |
| 752,574 | 2/1904 | Moses | 229/125.22 |
| 1,160,871 | 11/1915 | Forward | 229/198 |
| 1,555,054 | 9/1925 | Berkowitz | 229/125.22 |
| 1,690,852 | 11/1928 | Behrman | 229/125.22 |
| 1,725,526 | 8/1929 | Kondolf | 229/125.22 |
| 1,725,527 | 8/1929 | Kondolf | 229/125.22 |
| 1,760,325 | 5/1930 | Small | 229/192 |
| 2,340,124 | 1/1944 | Hoyt | 229/125.22 |
| 2,819,009 | 1/1958 | David, Jr. | 229/125.22 |
| 2,833,456 | 5/1958 | Welshenbach | 229/125.22 |
| 3,704,824 | 12/1972 | Croley | 229/192 |
| 3,937,392 | 2/1976 | Swicher | 229/125.22 |
| 3,954,219 | 5/1976 | Mangini et al. | 229/125.22 |

*Primary Examiner*—Gary E. Elkins
*Attorney, Agent, or Firm*—Hopkins & Thomas

[57] ABSTRACT

A securable cover for containers is provided, the cover having top and side panels in registry with the upper, lower or both ends of the container. The side panels have opposed and aligned apertures in each corner thereof which receives a flexible strap. The strap is horizontally disposed through each aperture, around the outer periphery of each side panel, and is fastened to itself at a selected point for securing the cover in place over the container.

6 Claims, 3 Drawing Sheets

SECURED COVER ASSEMBLY FOR CONTAINERS

BACKGROUND OF THE INVENTION

Corrugated containers are commonly used for shipping dry bulk commodities, for example, peanuts, resins, rubber, etc. Such containers may be sized to hold anywhere from several hundred to well over two thousand pounds of the particular commodity. Thus, substantial strength of the containers is a requirement due both to their capacity and the fact that the containers may be stacked for transport and/or storage.

At present, the strength of the containers themselves is a major concern. A weak link has been and continues to be the covers for the containers particularly when the containers are stacked on top of and next to one another. Prior art covers are prone to bulging out at the sides and corners, with the bulged out portions often becoming ripped or otherwise damaged from contact with other containers, stationary objects during transport, fork lifts, or simply due to the weight of the container stacked thereon. With many products, and especially foodstuffs, such damage is unacceptable as it may provide ingress for dirt, insects, and other foreign material.

Present securing methods normally involve vertical strapping which is wrapped around the container from top to bottom so as to secure the cover to the container using downward force. While the portions of the cover underneath the strapping may remain in place, such a method actually exacerbates the problem by causing bulging in the side walls of both the container and the cover.

SUMMARY OF THE INVENTION

It is therefore, one of the principal objects of the present invention to provide a secure method of closing a container using a cover or lid, in which the cover or lid incorporates both novel design features and a novel securing means.

Another object of the present invention is to provide a container cover and securing means which eliminate problems with bulging sides of the container and which is easily and quickly secured in place over the container.

A further object of the present invention is to provide a cover for a container and means for securing said cover in place which are easily and economically manufactured, and which are durable for providing a long service life.

These and other objects are attained by the present invention which relates to a cover for a container, the container and cover normally being of a corrugated paper material, although the invention is equally applicable to containers and covers made from virtually any material. Similarly, while the discussion herein will focus on large containers used for shipping bulk commodities, the present invention can be utilized with containers of any size.

The invention broadly comprises a container cover having aligned and effectively opposed apertures at each corner thereof. A securing means, such as a synthetic material or metallic strap is threaded through the apertures and around the perimeter of the cover. Utilizing this perimetrical wrapping maintains the sides of the cover in generally parallel alignment with the underlying side of the container. The threading of the strapping material through the corner apertures anchors the corners of the cover and prevents bulging thereof, by providing contact between the cover, the container, and the strapping material. The securing method of the present invention can also be practiced by a single worker which is, at the very least, difficult when using prior art securing methods. In addition, the length of the strapping material can be precisely determined, thereby providing cost and material savings in the strapping material.

Various additional objects and advantages will become apparent from the following description, with reference to the accompanying drawings.

DETAILED DESCRIPTION OF THE PREFERRED EMBODIMENT

Figure 1:
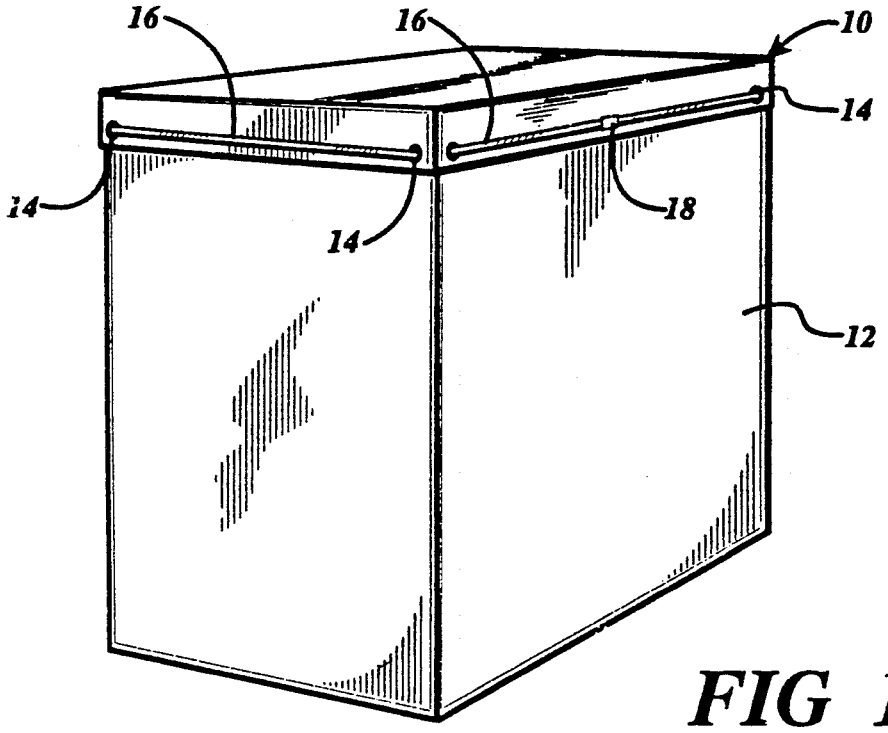
FIG. 1 is a perspective view of the present container cover in installed position.

Referring now more specifically to the drawings, and to FIG. 1 in particular, numeral 10 designates generally the present cover, shown in installed position on a container 12. The cover 10 is normally formed as a blank in a stamping operation, during which the appropriate score lines, fold lines, and apertures are developed in the material. While the present invention has its greatest utility in the field of corrugated containers, various other materials may be used, as will be apparent to those skilled in the art.

As shown in FIG. 1, the cover 10 is formed so as to nest in closing relationship with the container 12. Apertures 14 are formed near each corner in generally aligned relationship with each being generally opposed to the aperture in the adjacent corner. With the cover in position over the container, a suitable fastening means, such as a strap 16 is threaded through the opposing apertures in each corner. The strap extends completely around the periphery of the cover and is fastened to itself at a point normally mid-way between any two corners. The operation can easily be performed by a single worker and is done with no waste of strapping material as there need be only a minimum of overlap in the strapping material. A suitable clamp means 18 is placed around the overlapping strap portions and is crimped in place in a conventional manner.

Figure 5:
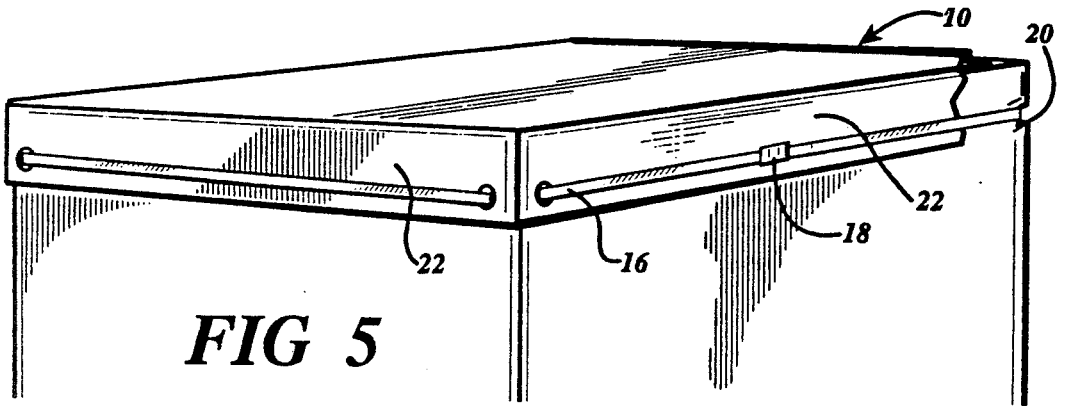
FIG. 5 is a partial perspective view illustrating the cover and the securing means therefor in place on the container.

The efficiency and security of the present invention are further illustrated in FIG. 5. As can be seen, depending on the pulling force applied when installing the strap, the tightening of the strap 16 can cause it to "bite" into the container at each corner thereof. This ensures that the cover is anchored down over the container by virtue of the interaction between the strap, the now indented corner portion 20, and the strap-receiving apertures 14. In addition, the sides 22 of the cover are held in close relationship to the container, enhancing the security and effectiveness of the cover and minimizing the chance that the side of the cover will be pulled outwardly and ripped through contact with an adjacent container, fork lift tines, etc.

Several possible embodiments of a cover design are illustrated in FIGS. 2A through 4C. All have the common feature of corresponding, opposed, and aligned apertures in the corner portions thereof, this being one of the primary characteristics of the present invention.

Figure 2A:
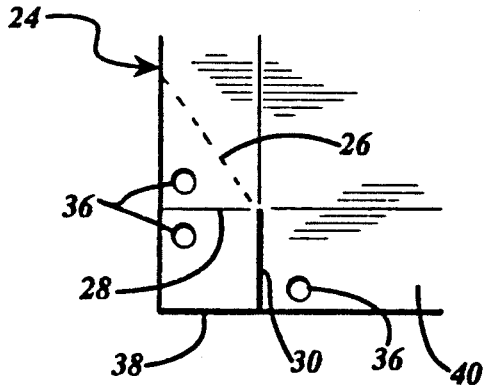
FIG. 2A is a partial, top plan view of an embodiment of the corner design for the present cover.

FIG. 2A illustrates a corner portion of a cover 24 designed for generally light duty, having only one reinforced side where the cover material is doubled in thickness. As shown in this and the following figures, the cover is shown with the inside surface of the cover facing the viewer. Thus, to construct the cover shown in FIG. 2A, the cover material is provided with a score line 26 for bending purposes, a corner bending line 28, and a cut line 30. Apertures 36 are formed in the respective corners. The apertures and the respective lines are formed from a blank, normally in an automated stamping and cutting operation. The covers are then folded inwardly along line 26 and glue is applied to the then exposed side of corner portion 38. Side portion 40 is then folded inwardly against the glued corner portion and pressed thereagainst to secure the side portion 40 to the corner portion 38. This operation may be done manually or with automated machinery. The cover is then normally shipped in a flattened condition until it reaches its final destination whereupon the sides are raised and the cover is installed, (as shown in FIG. 1).

Figure 2B:
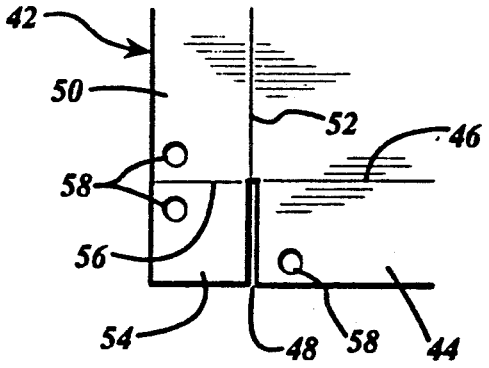
FIG. 2B is a partial, top plan view of an alternate embodiment of the corner design for the present cover.

FIG. 2B illustrates a corner of an alternate embodiment of a cover 43. In this embodiment, side panel 44 is folded inwardly along score line 46 by virtue of the cut 48. Side panel 50 is also folded inwardly along line score line 52 and corner portion 54 is folded over panel 44 along score line 56. Glue is applied on the then outwardly facing side of panel 44 and corner portion 54 is secured thereto. Apertures 58 are then in their opposed, aligned orientation across the corner for receiving the securing strap.

Figure 2C:
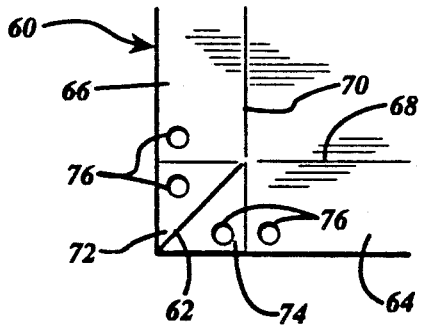
FIG. 2C is a partial, top plan view of another embodiment of the corner design for the present cover.
Figure 2D:
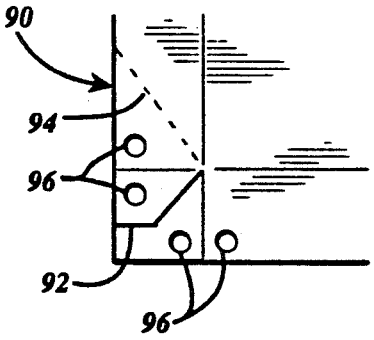
FIG. 2D is a partial, top plan view of a fourth embodiment of the corner design for the present cover.
Figure 3:
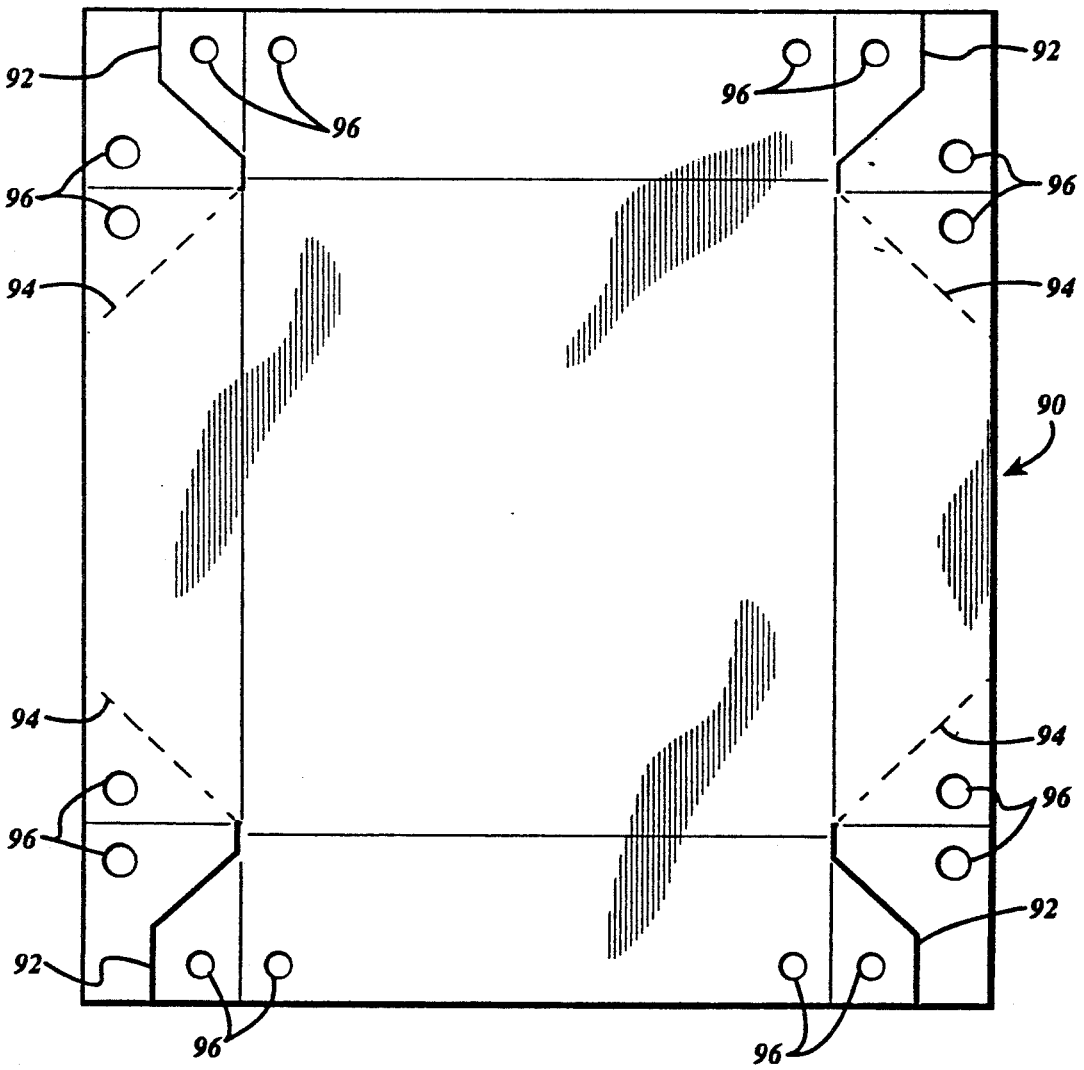
FIG. 3 is a top plan view of a preferred embodiment of the present cover in unfolded position.

FIG. 2C illustrates a corner of another embodiment of the present invention, cover 60. In this embodiment, the corner is cut diagonally along line 62. The side panels 64 and 66 are folded inwardly along lines 68 and 70, respectively. Glue is then normally applied to one or the other of the outwardly facing panel surfaces and to one or the other of the inwardly facing panel surfaces. Thus, when the corner is formed, corner portions 72 and 74 are disposed either on the inside or the outside of the corner. Apertures 76 are then in their aligned and opposed positions across the corner for receiving the securing strap.

FIGS. 2D through 4C illustrate a preferred embodiment of the present cover, the cover being doubly-reinforced at all of the corners. In this embodiment, cover 90 is formed from a cardboard blank, normally in an automated stamping/cutting operation. At each corner, cut lines 92 and score lines 94 are formed, as well as apertures 96. The plan view as shown in these figures is oriented with the inner surface of the cover facing the viewer.

Figure 4A:
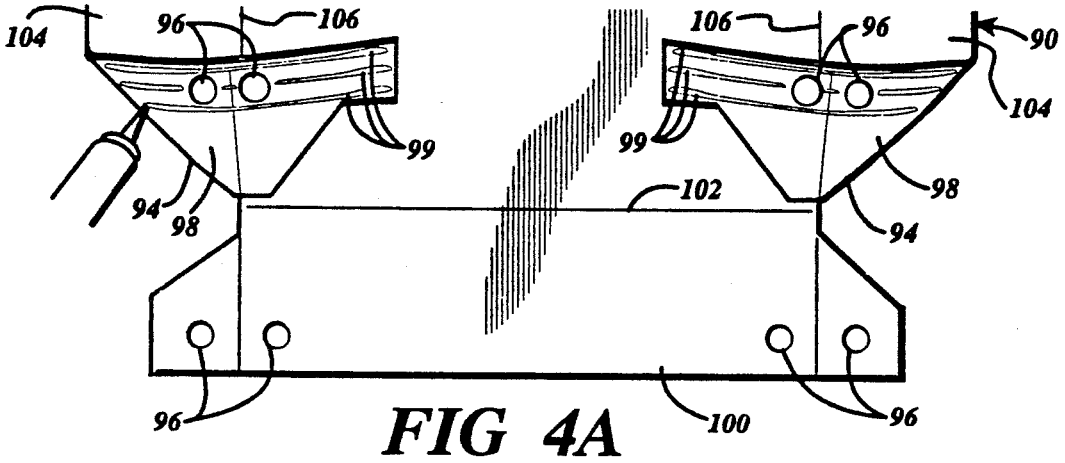
FIG. 4A is a partial top plan view of one side of the present cover illustrating the gluing and folding sequence for the cover shown in the preceding figure.
Figure 4B:
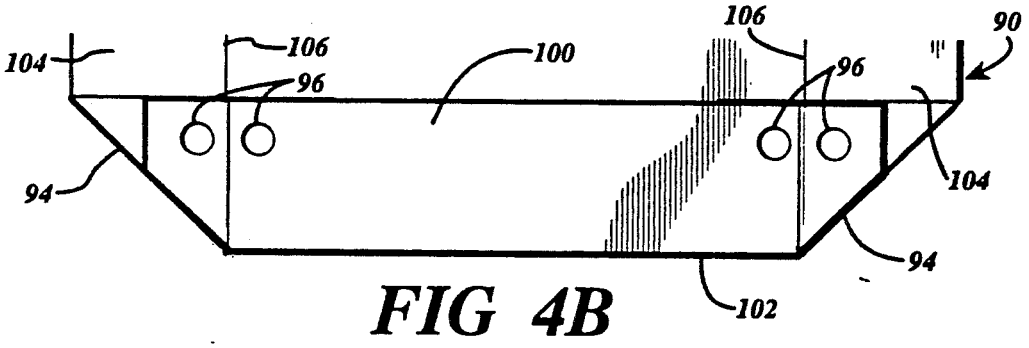
FIG. 4B is a partial top plan view of the glued cover prior to it being unfolded into its final configuration.
Figure 4C:
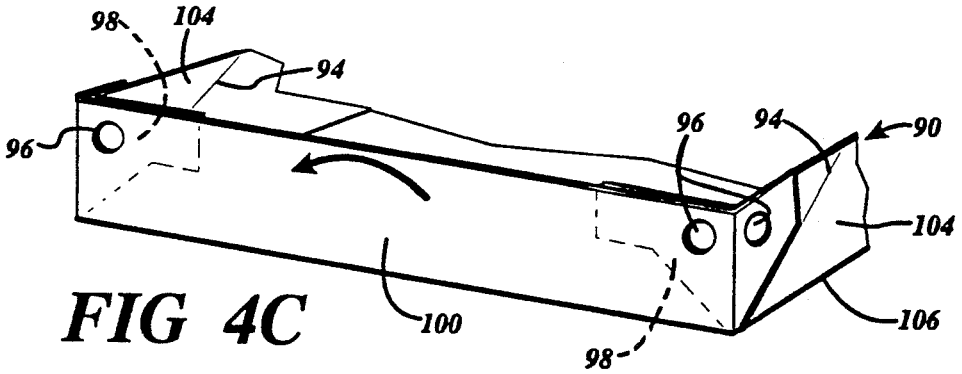
FIG. 4C is a partial perspective view of the cover shown in the preceding figure in its final configuration.

The assembly sequence is shown in FIGS. 4A through 4C. Initially, corner sections 98 are folded inwardly along score lines 94. Glue 99 is applied to the then outwardly facing sides of corner sections 98 in the vicinity of the apertures 96. Side panel 100 is then folded inwardly along fold line 102 and pressed against the corner sections to secure the elements together, as shown in FIG. 4B. The same operation is performed on the opposite side of the cover such that all four corners are glued yet the cover is in a flattened condition for ease of both manufacture and shipping.

When the cover 90 is to be used, the side panels 104 are folded inwardly along line 106. This causes the score line 94 to move from a folded to an unfolded condition, as shown in FIG. 4C. At the same time, the fold lines 108 move outwardly from a flattened to a folded position, the entire combination forming the completed corner. As can be seen in FIG. 4C, the apertures 96 are then in their aligned, opposed orientation across each corner, ready to receive the securing strap.

In the use and operation of the present invention, the cover configuration is chosen and produced as a flat stamping from a blank, which is normally cardboard but which may be any suitable material. The corners are then normally glued and shipped to the end user in a flattened state. The end user then needs only to raise the side panels, placing the corners in proper orientation to nest over the container. Beginning normally mid-way between two corners, the worker threads a securing strap through the corner apertures and around the perimeter of the cover. With the strap disposed through all of the corner apertures and adjacent the side panels of the cover, the strap 16 is pulled tight and secured to itself at the starting point thereof, using conventional clamping or crimping means 18. Depending on the container, the strap may "bite" into the container as it is pulled tight, as shown in FIG. 5. This would, of course, not occur with a metal container or where the strap is not pulled tight with sufficient force to indent the corner; however, the principle of having the strap disposed about the periphery of the cover while making intimate contact with the underlying container wall at the corners is the same.

The horizontal strapping provides superior resistance to bulging of the side panels, particularly when heavy containers are stacked vertically upon one another. The strap also prevents the folding score lines 94 from flaring outwardly under stress. The unique double corner construction shown in FIG. 3 also provides significant extra strength and durability for tear-out prevention while allowing reuse of the cover.

In addition to the cover embodiment illustrated herein, the present invention may also be utilized as the bottom of a container, the application being essentially the same. Similarly, the sides of the cover may extend along the sides of the container to any desired or necessary length, and such embodiments are considered to be within the scope of the invention.

Thus, it will be recognized by those skilled in the art, that a uniquely securable cover for containers is taught, providing greater shipping security against damaged loads, containers and/or covers, while also eliminating any waste of strapping material. The securing operation is also simpler than prior art methods and can easily be accomplished by a single worker, providing even greater utility and savings in use.

While an embodiment of a secured cover for containers and modifications thereof have been shown and described in detail herein, various additional changes and modifications can be made without departing from the scope of the present invention.

I claim:

1. A cover for a bulk container having at least four sides, said cover comprising:

a substantially rectangular surface having first, second, third and fourth depending flaps adapted to fit over the sides of said container, said flaps defining four corners, each of said corners comprising overlapped potions of two of said flaps adhered together to define a rigid rectilinear junction, each of said corners having first and second holes on either side of said junction, said holes extending through said overlapped portions of said flaps, and strap means for anchoring said cover to said container and for maintaining said depending flaps against said sides, said strap means passing through said holes and substantially around the outer periphery defined by said depending flaps.

2. The cover as defined in claim 1 in which said means for anchoring includes a flexible strap.

3. The cover as defined in claim 1 in which said holes are disposed in opposed and aligned relationship at each of said corners.

4. The cover as defined in claim 1, wherein said cover is formed from a blank comprising a generally rectangular panel having opposed first and second parallel edges and opposed third and fourth parallel edges oriented substantially at right angles to said first and second edges forming four corners, means for defining first and second parallel fold lines extending parallel to said first and second edges, and means for defining third and fourth parallel fold lines extending parallel to said third and fourth edges, said first and second parallel fold lines defining first and second flaps parallel to said first and second fold lines respectively, said third and fourth parallel fold lines defining third and fourth flaps parallel to said third and fourth fold lines respectively, said fold lines intersecting to form four junctions interiorly of said four corners, means for separating said first flap from said third and fourth flaps comprising first and second cuts in said first flap extending from said first edge to said first and second ones of said junctions, and means for separating said second flap from said third and fourth flaps comprising third and fourth cuts in said second flap extending from said second edge to third and fourth one of said junctions, first and second spaced holes in said first flap on either side of said third fold line, third and fourth spaced holes in said first flap on either side of said fourth fold line, first and second spaced holes in said second flap on either side of said third fold line and third and fourth spaced holes in said second flap on either side of said fourth fold line, first and second spaced holes in said third flap on either side of said first fold line and third and fourth spaced holes in said third flap on either side of said second fold line, and first and second spaced holes in said fourth flap on either side of said first fold line and third and fourth spaced holes in said fourth flap on either side of said second fold line.

5. The cover as defined in claim 4 in which said third and fourth flaps have corner portions and include additional fold lines, each extending radially from a corresponding corner to a periphery of said third and fourth flaps for facilitating the inward folding of said corner portions and said first and second flaps are then disposed over said inwardly folded corner portions and glued thereto for shipping and storage of said blanks in a flattened configuration.

6. The cover as defined in claim 5 in which said additional fold lines are disposed at approximately a forty-five degree angle relative to said third and fourth fold lines.

* * * * *